US009687995B2

(12) United States Patent
Simm

(10) Patent No.: US 9,687,995 B2
(45) Date of Patent: Jun. 27, 2017

(54) PORTABLE PLANING MACHINE

(71) Applicant: Robert Bosch GmbH, Stuttgart (DE)

(72) Inventor: Robert Simm, Oekingen (CH)

(73) Assignee: Robert Bosch GmbH, Stuttgart (DE)

( * ) Notice: Subject to any disclaimer, the term of this patent is extended or adjusted under 35 U.S.C. 154(b) by 455 days.

(21) Appl. No.: 14/270,940

(22) Filed: May 6, 2014

(65) Prior Publication Data

US 2014/0331508 A1 Nov. 13, 2014

(30) Foreign Application Priority Data

May 13, 2013 (DE) ..... 10 2013 208 705

(51) Int. Cl.
*B27C 1/10* (2006.01)
*B25F 5/00* (2006.01)

(52) U.S. Cl.
CPC ..... *B27C 1/10* (2013.01); *B25F 5/008* (2013.01)

(58) Field of Classification Search
CPC ..... B27C 1/10; B25F 5/008
USPC ..... 30/475–477; 144/114.1, 117.4, 154.5, 144/251.1–251.3
See application file for complete search history.

(56) References Cited

U.S. PATENT DOCUMENTS 4,433,710 A * 2/1984 Posta ..... B27C 1/10 30/475
4,584,772 A * 4/1986 Bergler ..... B23Q 9/0028 30/475
4,601,104 A * 7/1986 Zaiser ..... B23Q 11/005 30/475
4,920,651 A * 5/1990 Schmidt ..... B27C 1/10 30/475
5,176,478 A * 1/1993 Munch ..... B23C 1/20 144/208.1
5,233,750 A * 8/1993 Wolf ..... B27B 17/083 30/475
5,383,275 A * 1/1995 Hild ..... B23Q 11/0042 30/475
5,463,816 A * 11/1995 Bellew ..... B23Q 11/0042 144/252.1
5,815,934 A * 10/1998 Eichberger ..... B23Q 11/0046 144/252.1
6,289,956 B1 * 9/2001 Shriver ..... B23Q 11/006 144/114.1
6,688,349 B2 * 2/2004 Roshilavati ..... B23Q 11/0042 30/475
7,069,967 B2 * 7/2006 Park ..... B23Q 11/005 144/114.1

(Continued)

FOREIGN PATENT DOCUMENTS

DE 3542466 A1 * 6/1987
DE 29812699 U1 * 12/1999

(Continued)

*Primary Examiner* — Jason Daniel Prone
(74) *Attorney, Agent, or Firm* — Maginot, Moore & Beck LLP

(57) ABSTRACT

A portable planing machine has a rotatably mounted planing shaft in a housing. The planing shaft is driven by a drive motor. Furthermore, a fan wheel is configured to generate a cooling airflow. At least one cooling duct is integrated into the planing shaft. An outflow opening of the cooling channel is at a greater radial spacing from the rotational axis than an inflow opening of the cooling duct.

12 Claims, 5 Drawing Sheets

(56) References Cited

U.S. PATENT DOCUMENTS 7,069,968 B2 * 7/2006 Thomas ..... B23Q 11/005 144/154.5
7,108,028 B2 * 9/2006 Thomas ..... B23Q 11/005 144/117.1
7,296,603 B2 * 11/2007 Thomas ..... B23Q 11/005 144/114.1
7,299,838 B2 * 11/2007 Thomas ..... A47L 9/1427 144/117.1
7,299,839 B2 * 11/2007 Thomas ..... B23Q 11/005 144/117.1
7,422,040 B2 * 9/2008 Thomas ..... B23Q 11/005 144/114.1
7,455,090 B2 * 11/2008 Thomas ..... B23Q 11/005 144/117.1
7,549,450 B2 * 6/2009 Thomas ..... B23Q 11/005 144/154.5
8,136,559 B2 * 3/2012 Rosenau ..... B25F 5/006 30/475
2004/0068875 A1 * 4/2004 Wang ..... B23Q 11/005 144/114.1
2005/0284543 A1 * 12/2005 Kaiser ..... B27C 1/10 144/114.1
2007/0175044 A1 * 8/2007 Zaiser ..... B24B 55/10 30/475
2008/0289723 A1 * 11/2008 Janzen ..... B27C 1/10 144/137
2009/0000696 A1 * 1/2009 Grossman ..... B27C 1/10 144/117.4
2010/0307013 A1 * 12/2010 Refson ..... B27C 1/10 30/475
2015/0183125 A1 * 7/2015 Kumakura ..... B27C 1/10 30/475
2016/0151872 A1 * 6/2016 Glauning ..... B23Q 11/1092 173/3

FOREIGN PATENT DOCUMENTS

DE 198 53 374 A1 5/2000
DE 102013208705 A1 * 11/2014 ..... B27C 1/10
EP 0618050 A1 * 10/1994
WO WO 2007077050 A1 * 7/2007
WO WO 2015197240 A1 * 12/2015

* cited by examiner

PORTABLE PLANING MACHINE

This application claims priority under 35 U.S.C. §119 to patent application no. DE 10 2013 208 705.5, filed on May 13, 2013 in Germany, the disclosure of which is incorporated herein by reference in its entirety.

The disclosure relates to a portable planing machine in accordance with the claims.

BACKGROUND

Portable planing machines are known, for example from DE 198 53 374 A1, which have, in a housing, a rotatably mounted planing shaft which is driven by an electric drive motor and on the circumferential side of which a knife with a blade is arranged. In order to cool the electric drive motor, portable planing machines of this type can have a fan wheel which is driven by the motor shaft of the drive motor and is arranged on the end side of the drive motor. The fan wheel sucks air out of the surroundings and generates an air flow which is guided along the drive motor by the housing of the portable planing machine.

SUMMARY

The disclosure is based on the object of configuring a portable planing machine with effective cooling using simple structural measures.

According to the disclosure, this object is achieved by way of the features of the claims.

A portable planing machine according to the disclosure has a rotatably mounted planing shaft in a housing, which planing shaft is driven by an electric drive motor. Furthermore, the portable planing machine is equipped with a fan wheel, via which a cooling air flow is generated which is guided by the housing, in particular along the drive motor. The fan wheel is expediently driven by the drive motor, in particular is connected fixedly to a rotating part of the drive motor so as to rotate with it.

In a portable planing machine according to the disclosure, at least one cooling duct is integrated into the planing shaft, through which cooling duct the cooling air flow which is generated by the fan wheel is guided. The cooling duct in the planing shaft extends at an angle with respect to the planing shaft rotational axis, the inflow opening of the cooling duct in the planing shaft being at a smaller radial spacing from the rotational axis than the outflow opening. The cooling duct is advantageously of rectilinear configuration in the planing shaft, curved embodiments also possibly coming into consideration. On account of the oblique course of the cooling duct with a greater radial spacing of the outflow opening from the rotational axis than the inflow opening, an effect which assists the flow is achieved, which effect assists the flow-generating effect of the fan wheel. At this location, the greater spacing of the outflow opening in the cooling duct through the planing shaft leads to a suction effect which is superimposed on the increased pressure at the inflow opening which is situated downstream of the fan wheel. A cooling air flow is therefore sucked in from the surroundings by the fan wheel and is delivered downstream of the fan wheel into the cooling duct in the planing shaft, which runs with a radial component on the outside in the planing shaft. The cooling effect is improved on account of the assisting effect of the obliquely running cooling duct. Here, the cooling air flow is guided, in particular, along a component of the electric drive motor.

According to an embodiment, a plurality of cooling ducts are made in the planing shaft in a manner which is distributed over the circumference. For example, it can be expedient to provide a total of 12 cooling ducts, it being possible for the cooling ducts to be arranged to form groups, for example to be grouped in four different segments having in each case three cooling ducts. All the cooling ducts in the planing shaft are expediently at the same angle with respect to the planing shaft rotational axis.

According to another embodiment, a planing shaft is of hollow-cylindrical configuration, the inflow opening being arranged on the radial inner side of the planing shaft. Coming from the fan wheel, the cooling air flow is therefore first of all guided axially (parallel to the planing shaft rotational axis) through the interior of the hollow-cylindrical planing shaft as far as the inflow opening, whereupon the cooling air flow flows through the cooling duct of the planing shaft and is discharged via the outflow opening on the planing shaft, which outflow opening lies further to the outside radially. The outflow opening is advantageously situated on that end side of the planing shaft which faces away from the fan wheel.

In the case of a hollow-cylindrical embodiment of the planing shaft, the electric drive motor can be integrated into the interior of the planing shaft. This has the advantage that the cooling air flow can be guided axially on the drive motor until the inflow opening of the cooling duct on the planing shaft inner side is reached. The planing shaft is cooled at the same time on account of the flow through the cooling duct.

In the case of an integration of the drive motor into the interior space of the hollow-cylindrical planing shaft, the motor can be configured either as an external rotor motor, in which the rotor lies on the outside and is connected fixedly to the planing shaft. However, an internal rotor motor also comes into consideration, the motor shaft of which is connected fixedly to a hollow-cylindrical connecting component so as to rotate with it, which connecting component is coupled fixedly to the planing shaft. Here, the motor shaft is at the same time the support of the fan wheel which is arranged on the end side of the drive motor.

According to a further embodiment, in addition to the cooling air flow, the fan wheel also generates a chip discharge flow which serves to remove chips from the portable planing machine again, which chips are produced during the machining of workpieces and are sucked into the housing via the fan wheel. The mass flow which is conveyed in the chip discharge flow is possibly greater than that in the cooling air flow, for example twice as great.

The chip discharge flow and cooling air flow are advantageously guided through the portable planing machine via different paths. It can be expedient to convey the chip discharge flow along an annular channel which is formed in the circumferential direction on the fan wheel or a flange which surrounds the fan wheel radially, and is delimited axially by a cover which can be fastened to the housing and engages over the fan wheel. One or more air guide or flow guide elements can be configured on the cover inner side, which air guide or flow guide elements are preferably configured in one piece with the cover and via which influence can be exerted on the chip discharge flow. It is thus expedient, for example, that the annular channel has a variable cross section in the flow direction, in particular widens radially and/or tapers axially in the flow course. A flow guide element is, for example, of ramp-shaped configuration and protrudes into the annular channel in the axial direction, as a result of which the cross section of the annular channel is reduced axially. A plurality of part flows of the chip discharge flow can be generated or guided via the flow guide element or elements. For example, a first part flow of the chip discharge flow is accelerated within the fan wheel by the rotation and is ejected radially or tangentially into a section of the annular channel, where a combination with the air flow through the annular channel takes place. Subsequently, the entire chip discharge flow can open into a discharge channel which extends through the housing transversely with respect to the longitudinal axis of the portable planing machine, with the result that the chip discharge flow is guided out of the housing on the side which lies opposite the fan wheel, the chip discharge flow entraining the chips from the workpiece which are produced during the machining by the knife on the planing shaft.

Further advantages and expedient embodiments can be gathered from the claims, the description of the figures and the drawings

DETAILED DESCRIPTION

Figure 1:
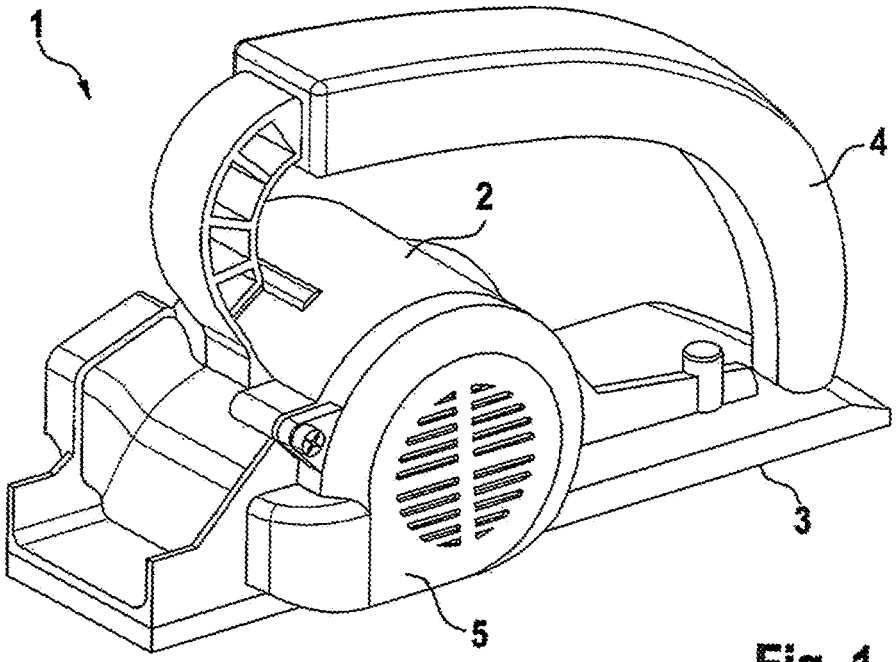
FIG. 1 shows a perspective view of a portable planing machine.

In the figures, identical components are provided with the same reference numerals.

FIG. 1 shows a portable planing machine 1 which, in a housing 2, has an electric drive motor and a planing shaft which is mounted rotatably in the housing and is driven by the drive motor. On its circumference, the planing shaft has one or more knives with a blade which removes workpiece material during workpiece machining. A base plate 3 is situated on the underside of the housing 2, which base plate 3 rests on the workpiece upper side and has a recess, through which the knife of the planing shaft protrudes. Furthermore, a handle 4 for holding and guiding the portable planing machine is arranged on the housing 2. A cover 5 is arranged laterally on the housing and is connected to the latter; the cover 5 covers a fan wheel which is seated axially on the end side of the electric drive motor and is driven by the latter. The portable planing machine 1 can be equipped with a planing depth setting means.

Figure 2:
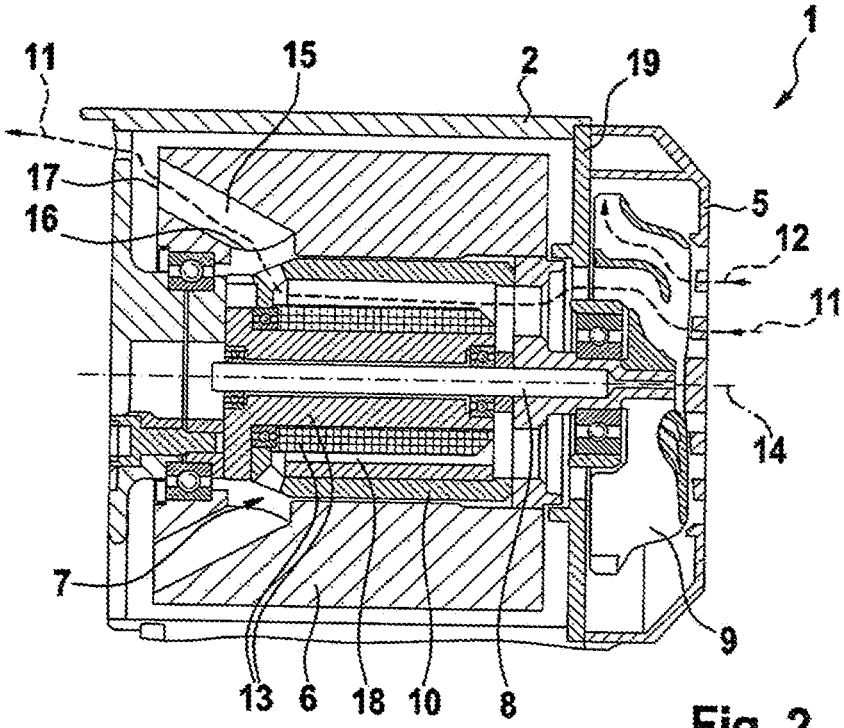
FIG. 2 shows a section transversely through the portable planing machine, into the planing shaft of which cooling ducts are integrated which extend at an angle with respect to the planing shaft rotational axis, with a fan wheel which is driven by the drive motor.

As can be gathered from the sectional illustration according to FIG. 2, the planing shaft 6 is of hollow-cylindrical configuration and accommodates the coaxially arranged electric drive motor 7 in its interior space. The motor shaft 8 of the drive motor 7 supports the fan wheel 9 which is connected fixedly to the motor shaft 8 so as to rotate with it and is arranged on the end side of the drive motor 7 or planing shaft 6. The fan wheel 9 is engaged over by the cover 5 which is connected to the housing 2.

The drive motor 7 has a connecting part 10 which is connected to the motor shaft 8 and rotates jointly with the latter. The connecting part 10 is of hollow-cylindrical configuration and bears against the inner wall of the planing shaft 6 and is connected fixedly to the planing shaft 6, with the result that the planing shaft 6 is also driven when the drive motor 7 is running.

The fan wheel 9 generates two air flows which are guided through the housing of the portable planing machine 1 and have different functions. A first air flow 11 is guided as a cooling air flow axially along the drive motor 7, in order to cool the latter. A second air flow 12 has the task of a chip discharge flow, via which chips which accumulate during workpiece machining are guided to the outside again out of the housing of the portable planing machine. Both air flows 11, 12 are introduced into the housing 2 via ventilation slots in the cover 5.

The fan wheel 9 does not extend further to the outside in the radial direction than the planing shaft 6 which has a greater external diameter than the fan wheel 9. The cooling air flow 11 lies offset radially further to the inside than the chip discharge flow 12.

The cooling air flow 11 is guided axially along the drive motor 7 along the inner side of the hollow-cylindrical connecting part 10. A cylindrical or annular channel, shown as a first cooling duct section 18 in FIG. 2, extends in the axial direction in relation to the rotational axis 14 of the planing shaft 6 and the motor shaft 8 is formed between the connecting part 10 and the radially inner stator 13 of the drive motor 7.

On the outflow side of the first cooling duct section 18 between the stator 13 and the cylindrical connecting part 10, the cooling air flow 11 enters into cooling ducts 15 which are made in the planing shaft 6. The cooling ducts 15 are of rectilinear configuration and extend at an angle with respect to the rotational axis 14, which angle lies at approximately 30° in the exemplary embodiment. Each cooling duct 15 has an inflow opening 16 on the radially inner side of the planing shaft 6 and an outflow opening 17 on that end side of the planing shaft which faces away from the fan wheel 9. On account of the oblique course of the cooling duct 15, the inflow opening 16 is at a smaller radial spacing from the rotational axis 14 than the outflow opening 17. During a rotation of the planing shaft 6, this assists the flow course from the first cooling duct section 18 into the cooling ducts 15. Downstream of the outflow opening 17, the cooling air flow can pass into the surroundings via slots in the housing.

Figure 3:
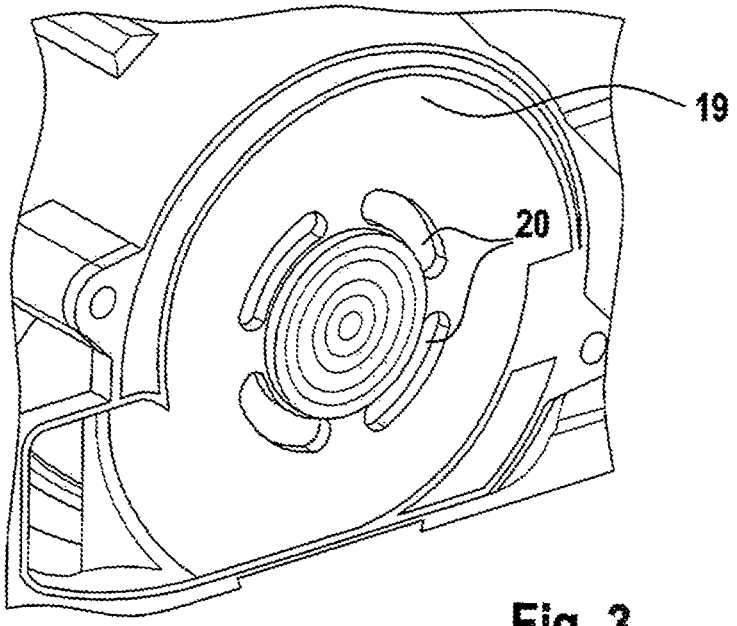
FIG. 3 shows a view of the end side of the portable planing machine below the fan wheel, with a plurality of inflow openings, via which the air flow which is generated by the fan wheel is guided into the interior of the portable planing machine.

A housing-side covering plate 19 is situated between the fan wheel 9 and the drive motor 7, in which covering plate 19 flow openings 20 are made, as can be gathered from FIG. 3. Via the flow openings 20, the cooling air flow 11 passes into the first cooling duct section 18 and, from there, further into the cooling ducts 15 in the planing shaft 6.

Figure 4:
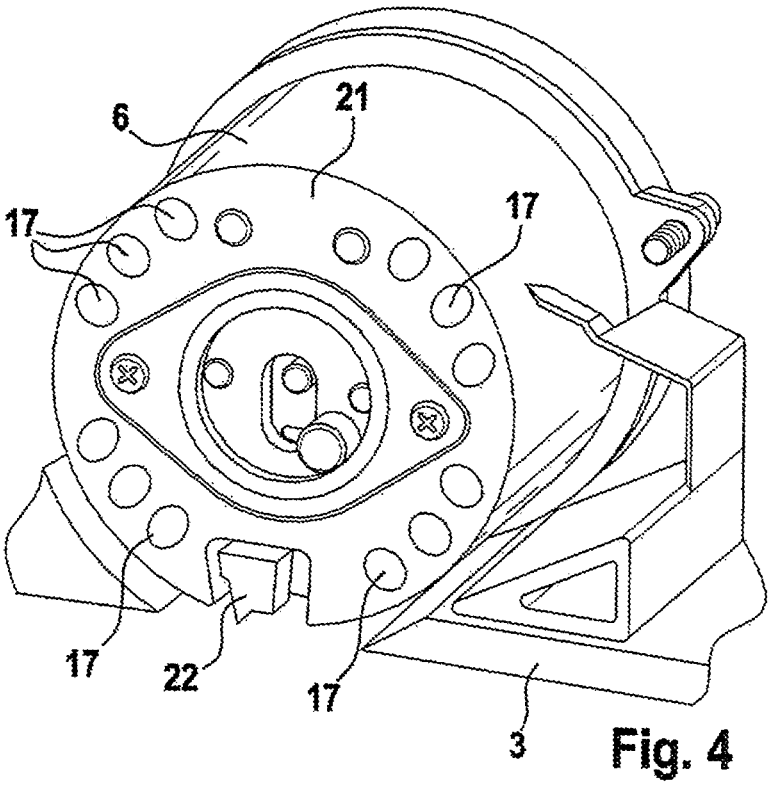
FIG. 4 shows a view of the end side of the planing shaft on the side which faces away from the fan wheel, with a plurality of outflow openings of the cooling ducts which are made in the planing shaft.

FIG. 4 shows the end side 21 of the planing shaft 6. The cooling ducts 15 which are made in the planing shaft 6 open with their outflow openings 17 on the end side 21. Distributed over the circumference, a total of 12 cooling ducts with in each case one outflow opening 17 are made in the planing shaft 6. The cooling ducts with the outflow openings 17 are combined in each case in groups of three cooling ducts which are arranged in a closely adjacent manner and are situated in each case in a 90° angular segment.

Moreover, the knife 22 can be gathered from FIG. 4, which knife 22 is arranged on the planing shaft 6 and, when the planing shaft is rotating, protrudes periodically through a recess in the base plate 3.

Figure 5:
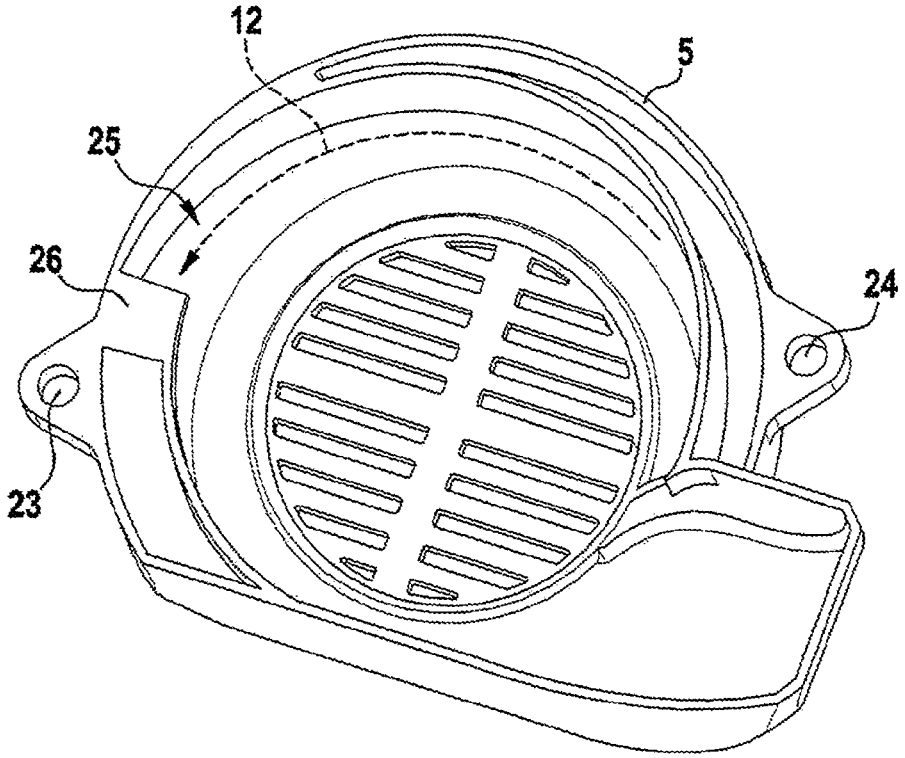
FIG. 5 shows a perspective view of a cover which can be placed onto the fan wheel and is to be connected to the housing of the portable planing machine.
Figure 6:
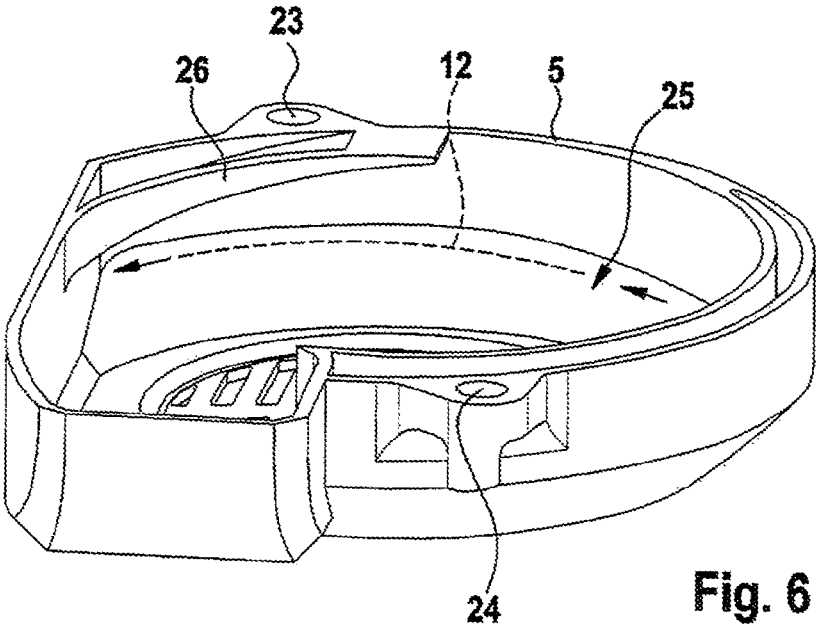
FIG. 6 shows the cover in a further perspective view.

FIGS. 5 and 6 in each case show the cover 5 which engages over the fan wheel in the mounted state. The cover 5 has fastening eyes 23 and 24, via which fastening to the housing of the portable planing machine is possible.

An annular channel 25 which extends in the circumferential direction for the chip discharge channel 12 is formed in the cover 5 adjacently with respect to the annular outer wall. The cover 5 delimits the chip discharge channel in the axial direction and radially to the outside. In the mounted state, the annular channel 25 is delimited radially to the inside by the outer side of the fan wheel 9.

In the flow direction, the cross section of the annular channel 25 widens in the radial direction. A flow guide element 26 which delimits the flow cross section of the annular channel 25 in the axial direction is configured in one piece with the outer wall of the cover 5. As can be gathered from the illustration according to FIG. 6, the flow guide element 26 is of ramp-shaped configuration and delimits the flow cross section in the flow direction axially in an increasing manner.

Figure 7:
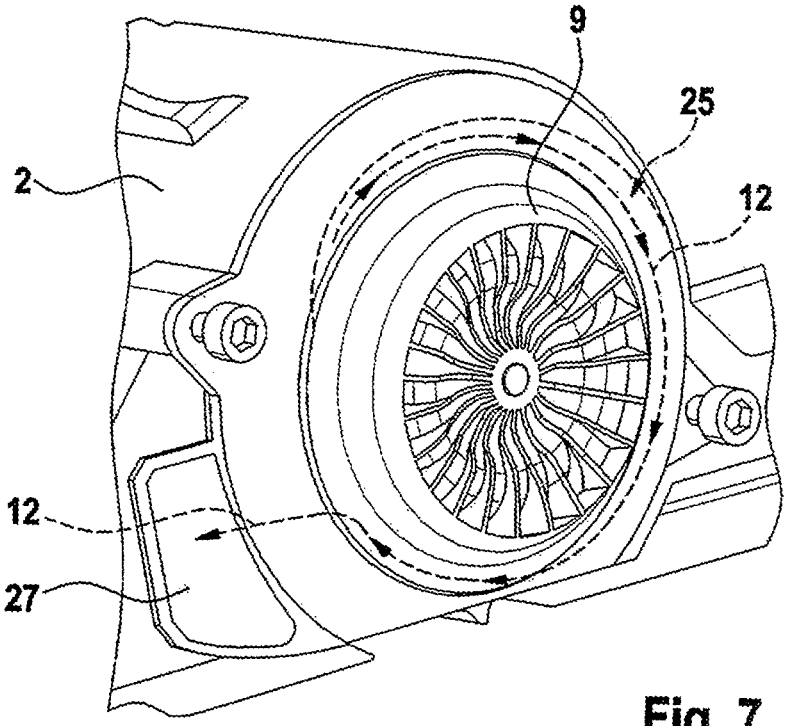
FIG. 7 shows the fan wheel in the mounted position on the portable planing machine, without the cover placed onto it.

FIG. 7 also shows the annular channel 25 on the housing side. It can be gathered in conjunction with the further FIGS. 8 and 9 that the chip discharge flow 12 opens into a discharge channel 27 in the housing, which discharge channel 27 extends through the housing 2 transversely with respect to the longitudinal axis of the portable planing machine 1 and guides the chip discharge flow 12 transversely through the housing, starting from the fan wheel 9, to the opposite side of the portable planing machine and discharges into the surroundings at this point.

Figure 8:
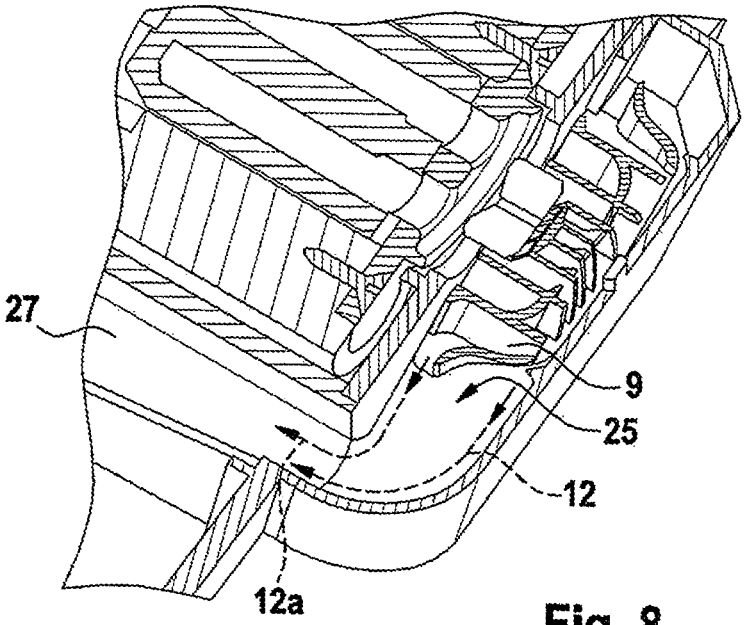
FIG. 8 shows a detailed illustration of the air guidance of a chip discharge flow, via which chips are blown out of the portable planing machine.
Figure 9:
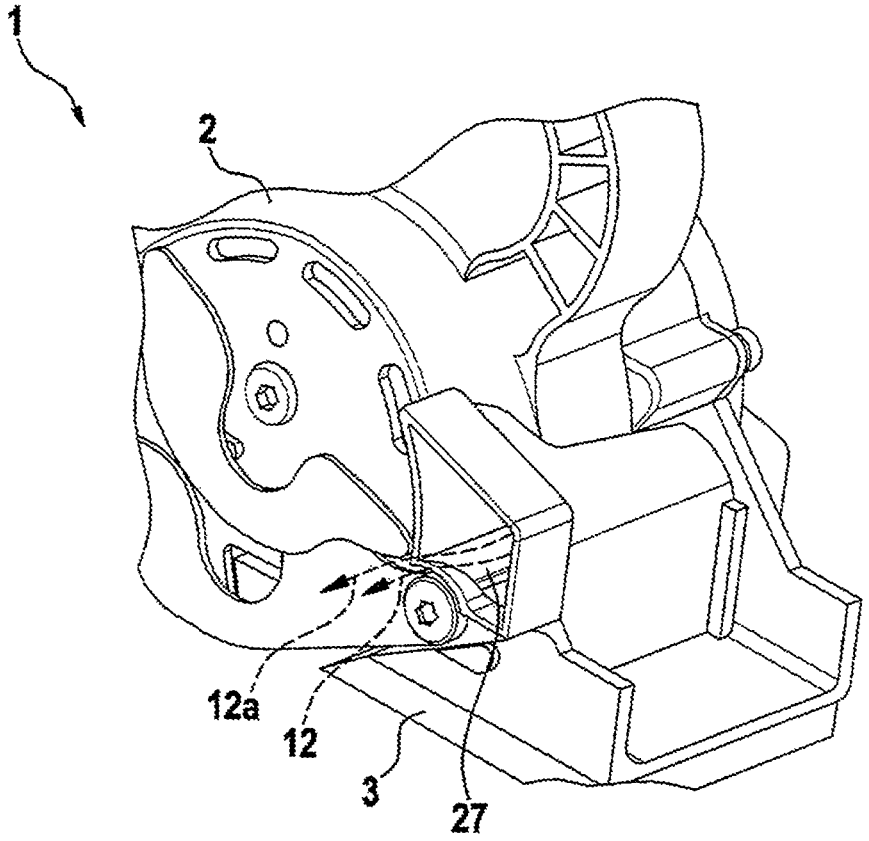
FIG. 9 shows a further perspective illustration of a portable planing machine with an outflow opening in the lateral housing region for discharging the chip discharge flow.

According to FIGS. 8 and 9, the chip discharge flow is divided into a first part flow 12 and a second part flow 12*a*, the first part flow 12 being guided, as described above, through the annular channel 25 in the circumferential direction between the outer side of the fan wheel 9 and the inner side of the cover 5. The second part flow 12*a* is situated within the fan wheel 9 and opens into the last section of the annular channel 25 (FIG. 8), which last section merges at a 90° angle into the discharge channel 27 which extends in the transverse direction. The ramp-shaped flow guide element 26 on the cover 5 deflects the first part flow 12 in the annular channel 25 axially, with the result that, as can be gathered from FIG. 8, the first and the second part flow 12 and 12*a* flow away in parallel and on different planes in the direction of the discharge channel 27 in the end section of the annular channel 25.

What is claimed is:

1. A portable planing machine, comprising:

a housing;

a planing shaft rotatably mounted in the housing, the planing shaft including at least one cooling duct having an outflow opening and an inflow opening, the planing shaft further including at least one blade; and an electric drive motor connected to the planing shaft and configured to drive the planing shaft, the electric drive motor including a fan wheel configured to generate a cooling air flow, wherein the outflow opening of the at least one cooling duct is positioned at a greater radial spacing from a planing shaft rotational axis than the inflow opening of the at least one cooling duct in the planing shaft.

2. The portable planing machine according to claim 1, wherein:

the planing shaft has a substantially hollow-cylindrical shape; and the inflow opening of the at least one cooling duct is located on a radial inner side of the planing shaft.

3. The portable planing machine according to claim 2, wherein:

the electric drive motor is integrated into the planing shaft by a connecting part; and the cooling air flow is guided axially along the electric drive motor by a channel formed between the connecting part and a stator of the drive motor to the inflow opening of the at least one cooling duct.

4. The portable planing machine according to claim 3, wherein a rotor or a motor shaft of the electric drive motor is fixedly connected to the planing shaft.

5. The portable planing machine according to claim 1, wherein the outflow opening of the at least one cooling duct is located on an end side of the planing shaft.

6. The portable planing machine according to claim 1, wherein the at least one cooling duct is a plurality of cooling ducts and the plurality of cooling ducts is distributed over a circumference of the planing shaft.

7. The portable planing machine according to claim 1, further comprising:

a cover fastened to the housing and defining at least one ventilation slot and an annular channel extending in a circumferential direction wherein the annular channel is located between an inner side of the cover and the fan wheel.

8. The portable planing machine according to claim 7, wherein the annular channel opens into a discharge channel which extends through the housing transversely with respect to a longitudinal axis of the portable planing machine.

9. The portable planing machine according to claim 7, wherein the annular channel has a variable cross section over a length of the annular channel.

10. The portable planing machine according to claim 9, further comprising a flow guide element formed as one piece with the cover, wherein the flow guide element protrudes into the annular channel.

11. The portable planing machine according to claim 10, wherein:

the flow guide element has a ramp-shaped configuration; and the variable cross section of the annular channel has an axial taper.

12. The portable planing machine according to claim 10, wherein the fan wheel is configured to generate an air flow that enters the annular channel downstream of the flow guide element.

* * * * *